United States Patent [19]

Busch et al.

[11] 4,047,071

[45] Sept. 6, 1977

[54] LAMP HAVING AMALGAM CONTAINED IN A POROUS SILICATE MASS

[75] Inventors: Lothar Busch, Munich; Günter Franck, Ebenhausen, both of Germany

[73] Assignee: Patent-Treuhand-Gesellschaft fur Elektrische Gluhlampen mbH, Munich, Germany

[21] Appl. No.: 665,054

[22] Filed: Mar. 8, 1976

[30] Foreign Application Priority Data

Mar. 10, 1975 Germany ..... 2510379

[51] Int. Cl.[2] ..... H01J 61/28; H01J 61/42

[52] U.S. Cl. ..... 313/490; 313/174; 252/181.6

[58] Field of Search ..... 313/490, 178, 174; 252/181.6, 181.7

[56] References Cited

U.S. PATENT DOCUMENTS

| | | | |
|---|---|---|---|
| 2,073,715 | 3/1937 | Stone et al. | 313/174 |
| 3,048,737 | 8/1962 | Rimbach | 313/174 |
| 3,629,641 | 12/1971 | Hofmann et al. | 313/490 X |
| 3,898,720 | 8/1975 | Morehead | 313/178 X |

*Primary Examiner*—Palmer C. Demeo

*Attorney, Agent, or Firm*—Flynn & Frishauf

[57] ABSTRACT

Mercury vapor discharge lamps in which the amalgam is contained in a porous (solid-state) silicate mass which is secured to an internal surface of the lamp. The invention also provides electrode-containing components for fluorescent lamps wherein the component has an amalgam-forming composition contained in a silicate mass secured to a portion of the said component. The invention further provides a method of manufacturing said electrode-containing component and said lamp.

9 Claims, 2 Drawing Figures

LAMP HAVING AMALGAM CONTAINED IN A POROUS SILICATE MASS

BACKGROUND OF THE INVENTION

This invention relates to low pressure mercury vapor discharge lamps having high electrical and/or thermal loading, and preferably to fluorescent lamps containing an amalgam. The vapor pressure of such lamps is determined by the characteristics of the amalgam to have a lower mercury vapor pressure than free mercury at the same temperature.

As is well known, (i) the composition of the amalgam both in relation to the selection of the amalgam-forming metal and to its quantitative proportion in the alloy, and (ii) also the location of the amalgam-forming metal or amalgam, respectively, is of importance for the amalgam function within the lamp in order to adapt the lamp to a predetermined use or to obtain a lamp for use in a wide variety of applications. The temperature in a given location within the lamp is determinative of the possibility of locating an amalgam therein.

Many different locations and modes of application of the amalgam are known, such as applying the amalgam at a predetermined distance from the electrodes, preferably to the inner wall surface of the discharge tube in the form of a strip, a film, or a pellet. The amalgam then was secured in the predetermined location by rolling, or it was placed on a metal foil coated with a plastic adhesive and the metal foil was secured in the location, or, after heating to softening temperature, it was thrust by pressure against the bulb wall for adhesion (see U.S. Pat. No. 3,152,278; U.S. Pat. No. 3,160,778; U.S. Pat. No. 3,351,797 and German Patent DT-PS No. 1 149 818). It is also known to position the amalgam in a sieve-like container (see British Pat. No. 1,097,090) or to place around the lamp stem a mesh of nickel saturated with indium as the amalgam-forming metal (see Ill. Eng. 60 (1965), No. 9, page 534) or, to apply the amalgam-forming metal as a fine dispersion by spraying on the flare of at least one electrode stem (see U.S. Pat. No. 3,548,241).

It is an object of the present invention to provide a lamp in which the amalgam or the amalgam-forming metal has been secured in an improved manner.

SUBJECT MATTER OF THE INVENTION

The present invention provides low-pressure mercury vapor discharge lamps which in service have high electrical and/or thermal loading. These lamps contain at least one amalgam. The amalgam is secured to an internal portion of the lamp. The amalgam (and before provision of the mercury, the amalgam-forming metal) is contained in a porous solid silicate mass which is secured to an internal portion of the lamp. The invention also provides an electrode-containing component for fluorescent lamps having an amalgam or amalgam-forming metal secured to a surface of said component by being contained in a porous solid silicate mass which is secured to said surface of said component.

The invention also provides a process for manufacturing the aforeidentified lamps and electrode-containing lamp components, by admixing the amalgam-forming metal or the amalgam, respectively, in a silicate solution, preferably sodium an/or potassium silicate, to form a highly viscous liquid and/or semi-solid material. A specified amount of this viscous material containing the desired amount of amalgam-forming metal or amalgam is then applied to the desired location on the internal portion of the lamp (which is usually a portion of the electrode-containing component), and then heated until it is dried to form the silicate. This drying operation is usually performed in two steps, i.e., the component with the highly viscous mass of solution containing the amalgam-forming metal or amalgam attached thereto is dried, e.g., by exposure to radiant heaters or other source of heat. The component is then inserted into the lamp and during the further processing of the lamp which includes securing (melting in) the mount (stem) at elevated temperatures, the silicate becomes a porous solid body which contains the amalgam, and before provision of the mercury, only contains the amalgam-forming metal.

Figure 1:
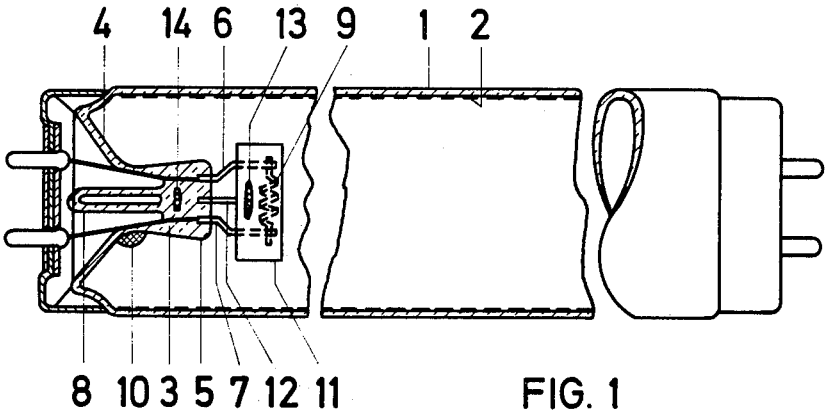
FIG. 1 is a partial sectional view of a fluorescent lamp with an amalgam secured on a portion of the lamp stem.

The metals which are known to be suitable amalgam-forming metals for use in lamps may be used in the present invention. The preferred amalgam-forming metals (including alloys) are indium cadmium, indium-magnesium alloys, and indium-calcium alloys; for example, those disclosed in our U.S. Pat. No. 3,906,284. For lamps having a power input of up to about 65 watts, amalgam compositions in the range of $Hg_1In_6$ to $Hg_1In_{12}$ are useful as the amalgam, i.e., the main $Hg_1In_6$ to $Hg_1In_{12}$ are useful as the amalgam, i.e., the main main amalgam, which determines the equilibrium vapor pressure during stable operating conditions of the lamp. Compositions in the range of from $Hg_1In_{10}$ up to $Hg_1In_{30}$ are suitable for use in high intensity lamps having a power input of up to about 140 watts.

The mercury component in the quantity of amalgam present in such lamps is about 15 mg. Amalgams of such composition functioning as the main amalgam may be applied to the flare or other portion of the electrode mount, or also to an internal portion of the lamp bulb, in the form of a droplet of material. The amalgams used in the lamps as the start-up amalgam or amalgams may be of the same composition as aforesaid. They are used in smaller amounts, however, only about 10% of the amount of the main amalgam. Such start-up amalgams are merely used for furnishing a quick source of mercury immediately after the lamp has been lighted. To obtain the minimum thermal inertia on lighting of the lamp, such start-up amalgams are located closer to the electrode than the main amalgam or amalgams.

The preferred silicate solutions are sodium and/or potassium silicate solutions. Those that are particularly preferred are water glass solutions, namely, solutions of sodium silicate and sodium tetrasilicate having a density of from about 1.35 to about 1.39. Solutions having a density of 1.37 are particularly preferred. Alternately, a water glass solution may be prepared by diluting water glass in a volume ratio of water glass to water of up to about 1:15, and preferably up to about 1:10. When the solutions are more dilute, both bonding and adhesive strength are impaired.

The weight ratio of amalgam-forming metal which is preferably admixed in the form of metal powder with the water glass solution, when utilizing a solution having a density of from 1.35 to 1.39, is from about 15:1 to about 0.5:1, and preferably from about 10:1 to 2:1. When using indium as the amalgam-forming metal, the ratio is preferably about 4:1. The silicate solution containing the metal powder is in the form of a viscous mass, probably a gel. Sufficient of this highly viscous mass in the form of a droplet is used to provide an amalgam in the completed lamp which provides the desired amount of mercury in the desired composition to provide the desired lamp characteristics.

The dry weight of the final porous solid silicate mass containing the amalgam-forming metal may be calculated as follows:

When the desired amalgam contains 15 mg of mercury in an amalgam composition $Hg_1In_9$, 77.3 mg of indium are required. The dry weight of the mass is calculated in accordance with the following formula:

$$m_T = m_{In}(1 + \frac{m_{WG} \cdot n}{m_e})$$

where $m_T$ = dry weight of the mass (droplet)

$m_{In}$ = mass of the indium in the droplet $m_{WG}$ = dry weight of 1 ml-water glass solution of the density 1.37 (=0.62 g/ml)

$m_e$ = mass of the indium when preparing the paste $n$ = number of ml of water glass of the density 1.37 which was used with $m_e$ indium when preparing the paste.

The foregoing is exemplified in the preparation of a droplet of pasty mass which was prepared by admixing 100 grams of powdered indium with 16.5 ml., this 22 grams of a water glass solution having a density of 1.37. This provides a weight ratio of 4.5:1.

This produces a pasty mass which is applied in the form of droplets to the ultimate amalgam support on an internal portion of the lamp. A droplet which will produce an amalgam containing 77.3 mg of indium will have a dry weight in accordance with the foregoing of 85.2 mg.

The pasty mass comprising the silicate with the amalgam-forming metal or the amalgam admixed therein is readily applied to the desired support on an internal portion of the lamp, and preferably on a portion of the electrode component. The sticky mass adheres well to the substrate to which it is applied. The pasty mass is readily dispensed in precisely metered droplet amounts by commercially available paste metering devices. The droplet may be located wherever desired by the lamp designer to obtain maximum lamp characteristics as a consequence of the ready and excellent adhesion of the droplet to the substrate. This is an advantage over the prior art which encountered technical requirements for securing the amalgam-forming metal or amalgam to the substrate which restricted choice of location thereof. The present invention permits such a wide choice that the droplet may be secured even in colder portions of the electrode stem, for example, on the periphery of the flare, thus permitting savings in the utilization of the amalgam-forming metal, e.g., indium. A second important advantage of the present invention is that in the finished lamp the porous solid silicate contains the amalgam-forming metal and amalgam so that there is no flow or detachment (fragmentation) of the amalgam during the service life of the lamp. This results in a constant photometric lamp characteristic during the service life of the lamp. These advantages are obtained without impairment (lowering) of the luminous flux or of the service life of the lamp which might have been expected to be deleteriously affected by the presence of the water glass solution which is cured during the final heating (baking) to form the porous (solid) silicate mass containing the amalgam.

Figure 2:
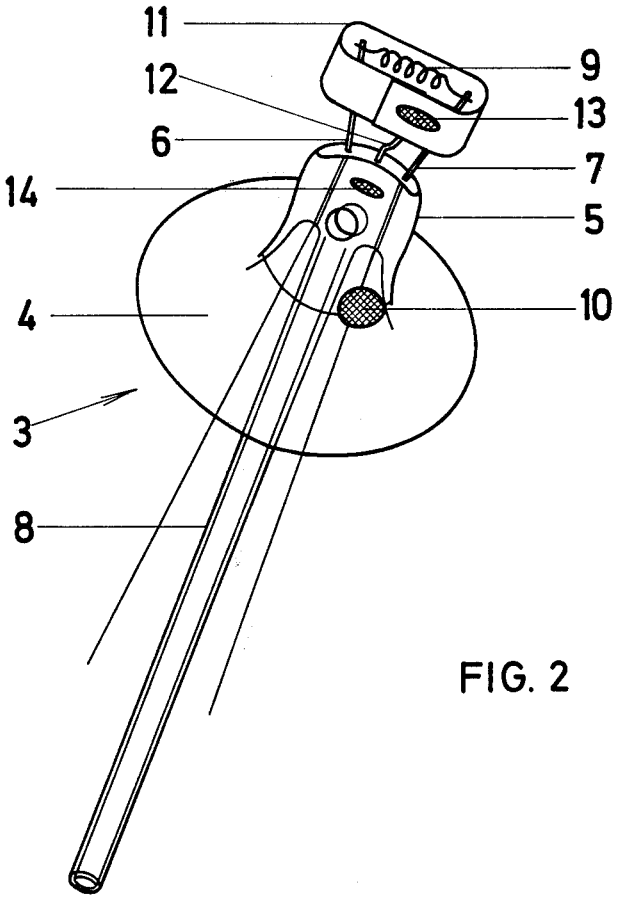
FIG. 2 illustrates a perspective view of an electrode-containing component having the amalgam-forming metal contained in a silicate mass secured thereto.

The invention is further illustrated with reference to the drawings. Identical parts on the two figures are designated by the same reference numeral. The light-transmitting lamp envelope 1 has a phosphor coating 2 on its inner surface. It has an electrode stem 3 sealed into its end. A perspective view of the electrode stem before it is incorporated into the lamp is depicted in FIG. 2. The electrode stem 3 comprises the flare 4 and the stem press (pinch) seal 5 through which the lead-in wires 6 and 7 extend. It also contains the exhaust tube 8. The electrode coil 9 which is coated with an oxide paste is connected to the inner ends of lead-in wires 6 and 7. The porous mass of silicate containing the amalgam-forming metal 10 (in FIG. 1) is secured on the flare 4. FIG. 2 illustrates the corresponding structure with the silicate mass 10 containing the amalgam-forming metal. The dry weight of the mass 10 is 84 mg and it contains 76 mg of indium. In FIG. 7, the mercury component of the amalgam weighs 15 mg. The electrode coil 9 is surrounded by a metal cap 11. Cap 11 is supported by wire 12. Cap 11 also functions as a supporting surface for start-up amalgam 13. Another start-up amalgam 14 is positioned on the seal 5. In FIG, 2, amalgam-forming metals 13 and 14 correspond to the start-up amalgams 13 and 14 of FIG. 1. The start-up amalgams may be contained in a porous silicate mass in the same manner as the main amalgam 10, or may be in the form of the metal secured to the substrate by known means.

We claim:

1. A low pressure mercury vapor discharge lamp of the fluorescent type comprising a light-transmitting envelope sealingly enclosing spaced discharge means and an amalgam contained in a porous silicate mass which is secured on an interior surface of said lamp which determines the equilibrium pressure during operation of the lamp, said amalgam comprising mercury and an amalgam-forming metal, said amalgam-containing porous silicate having been prepared by admixing the amalgam-forming metal in a water glass solution having a density between 1.35 and 1.39, with a weight ratio on a dry basis of amalgam-forming metal to water glass of from 15:1 to 0.5:1.

2. The lamp of claim 1 wherein said water glass solution has a density of about 1.37.

3. The lamp of claim 2 wherein said porous silicate mass containing said amalgam was prepared by admixing the amalgam-forming metal in said water glass in a weight ratio on a dry basis of from 10:1 to 2:1.

4. The lamp of claim 3 wherein said ratio is between about 4:1 and 4.5:1.

5. The lamp of claim 3 wherein said space discharge means are spaced electrodes each mounted on an electrode stem having a flared portion, wherein said porous silicate mass containing the amalgam is secured to the flared portion, wherein said amalgam contains about 15 mg of mercury, and wherein said amalgam has a composition in the range of $Hg_1In_6$ to $Hg_1In_{12}$, said lamp being adapted for use with a power input of up to 65 watts.

6. The lamp of claim 3 wherein said space discharge means are spaced electrodes each mounted on an electrode stem having a flared portion, wherein said porous silicate mass containing the amalgam is secured to the flared portion, wherein said amalgam contains about 15 mg of mercury, and wherein said amalgam has a composition in the range of $Hg_1In_{10}$ to $Hg_1In_{30}$, said lamp being adapted for use with a power input of up to 140 watts.

7. The lamp of claim 1 wherein said amalgam-forming metal is selected from the group consisting of indium, cadmium, and indium alloys.

8. The process of producing the lamp of claim 1 comprising admixing an amalgam-forming metal powder in a water glass solution to form a pasty mass, applying a measured amount of said pasty mass to a surface which is or will become an internal portion of said lamp, heating said pasty mass secured to said internal portion until subsequently all of the liquid component of said pasty mass is removed, and then assembling said lamp and baking at high temperature to seal it and cause said mass secured to said inner surface to become a porous solid containing said amalgam-forming metal.

9. The process of claim 8 wherein said amalgam-forming metal is selected from the group consisting of indium, cadmium, and indium alloys.

* * * * *